US008934802B2

(12) United States Patent
Koyanagi et al.

(10) Patent No.: US 8,934,802 B2
(45) Date of Patent: Jan. 13, 2015

(54) IMAGE FORMING APPARATUS

(71) Applicant: Canon Kabushiki Kaisha, Tokyo (JP)

(72) Inventors: Noriaki Koyanagi, Toride (JP); Kazuhiro Saitou, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 13/861,486

(22) Filed: Apr. 12, 2013

(65) Prior Publication Data

US 2013/0283944 A1 Oct. 31, 2013

(30) Foreign Application Priority Data

Apr. 26, 2012 (JP) ..... 2012-101848

(51) Int. Cl.
*G03G 15/00* (2006.01)
*B41J 13/14* (2006.01)

(52) U.S. Cl.
CPC *B41J 13/14* (2013.01); *G03G 15/00* (2013.01)
USPC ..... 399/81

(58) Field of Classification Search
CPC ..... G03G 15/5016
USPC ..... 399/81
See application file for complete search history.

(56) References Cited

FOREIGN PATENT DOCUMENTS

| | | |
|---|---|---|
| JP | 2006-83551 A | 3/2006 |
| JP | 2010-102143 A | 5/2010 |

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus includes a main assembly, a rotatable unit, a first gear, provided in one of the rotatable unit and the main assembly, including a gear portion at an arcuate portion having a center substantially aligned with a rotation center of the rotatable unit, and a second gear, provided rotatably in another one of the rotatable unit and the main assembly, engageable with the first gear in a first rotation region of the rotatable unit. In addition, a third gear is provided at a position different from the second gear with respect to a circumferential direction of the arcuate portion and is engageable with the first gear when the rotatable unit is rotated in a second rotation region thereof. A damper mechanism imparts rotational resistance to the second and third gears when each of the second and third gears is rotated.

9 Claims, 13 Drawing Sheets

IMAGE FORMING APPARATUS

FIELD OF THE INVENTION AND RELATED ART

The present invention relates to an image forming apparatus, using an electrophotographic system or the like, such as a copying machine or a laser (beam) printer.

In the image forming apparatus, using the electrophotographic system or the like, such as the copying machine or the laser printer, a damper has been conventionally provided at a rotation center of a rotationally movable unit (rotatable unit) to realize improvement of operativity and ensuring of safety.

For example, proposal that an operating portion is tilted (inclined) so that shorter people and wheelchair users can operate the image forming apparatus has been made.

At an operating portion of an image forming apparatus proposed in Japanese Laid-Open Patent Application (JP-A) 2010-102143, a damper using a torsion spring is provided at a rotation center of the operating portion, so that the operating portion can be held in a freestanding state at an arbitrary angle.

In the conventional image forming apparatus, in order to improve the operativity of the rotatable unit and ensure the safety, the damper was provided at the rotation center in general.

However, in this case, when the damper was intended to be disposed on a heavy-weight unit, there was a need to use a high-torque damper, thus causing an increase in cost and an increase in size of the image forming apparatus.

As an example, an operating portion provided with a damper at its rotation center as shown in FIG. 21 will be described. In this case, in order to hold an operating portion 22 in a freestanding state at an arbitrary angle, a torque of dampers 40 is required to be made larger than the self-weight of the operating portion 22 and an urging force when a user presses down a button. For that reason, a relatively large torque of the dampers 40 is needed. Although the torque varies depending on a size, weight and an urging (pressing) position of the operating portion 22, the operating portion of, e.g., about 400 mm in width, about 150 mm in depth and about 60 mm in height requires the torque of about 1.5 N·m. In order to realize this torque, there was a need to provide relatively expensive dampers having a large size, so that increases in cost and size of the image forming apparatus were invited.

Thus, with respect to the conventional image forming apparatus, in some cases, it was difficult to downsize the rotatable unit and the image forming apparatus by reduction in thickness of the rotatable unit used as the operating portion.

SUMMARY OF THE INVENTION

Accordingly, a principal object of the present invention is to provide an image forming apparatus capable of downsizing a rotatable unit provided rotatably relative to an apparatus main assembly.

According to an aspect of the present invention, there is provided an image forming apparatus comprising: a main assembly; a rotatable unit provided rotatably relative to the main assembly; a first drive transmission member, provided in one of the rotatable unit and the main assembly, including a drive transmission portion at an arcuate portion thereof having a center substantially aligned with a rotation center of the rotatable unit; a second drive transmission member, provided rotatably in another one of the rotatable unit and the main assembly, engageable with the first drive transmission member in a first rotatable region of the rotatable unit; a third drive transmission member provided at a position different from a position of the second drive transmission member with respect to a circumferential direction of the arcuate portion of the first drive transmission member, wherein the third drive transmission member is engageable with the first drive transmission member when the rotatable unit is rotated in a second rotatable region thereof; and a damper mechanism for imparting rotational resistance to the second and third drive transmission members when each of the second and third drive transmission members is rotated.

These and other objects, features and advantages of the present invention will become more apparent upon a consideration of the following description of the preferred embodiments of the present invention taken in conjunction with the accompanying drawings.

Figure 5:
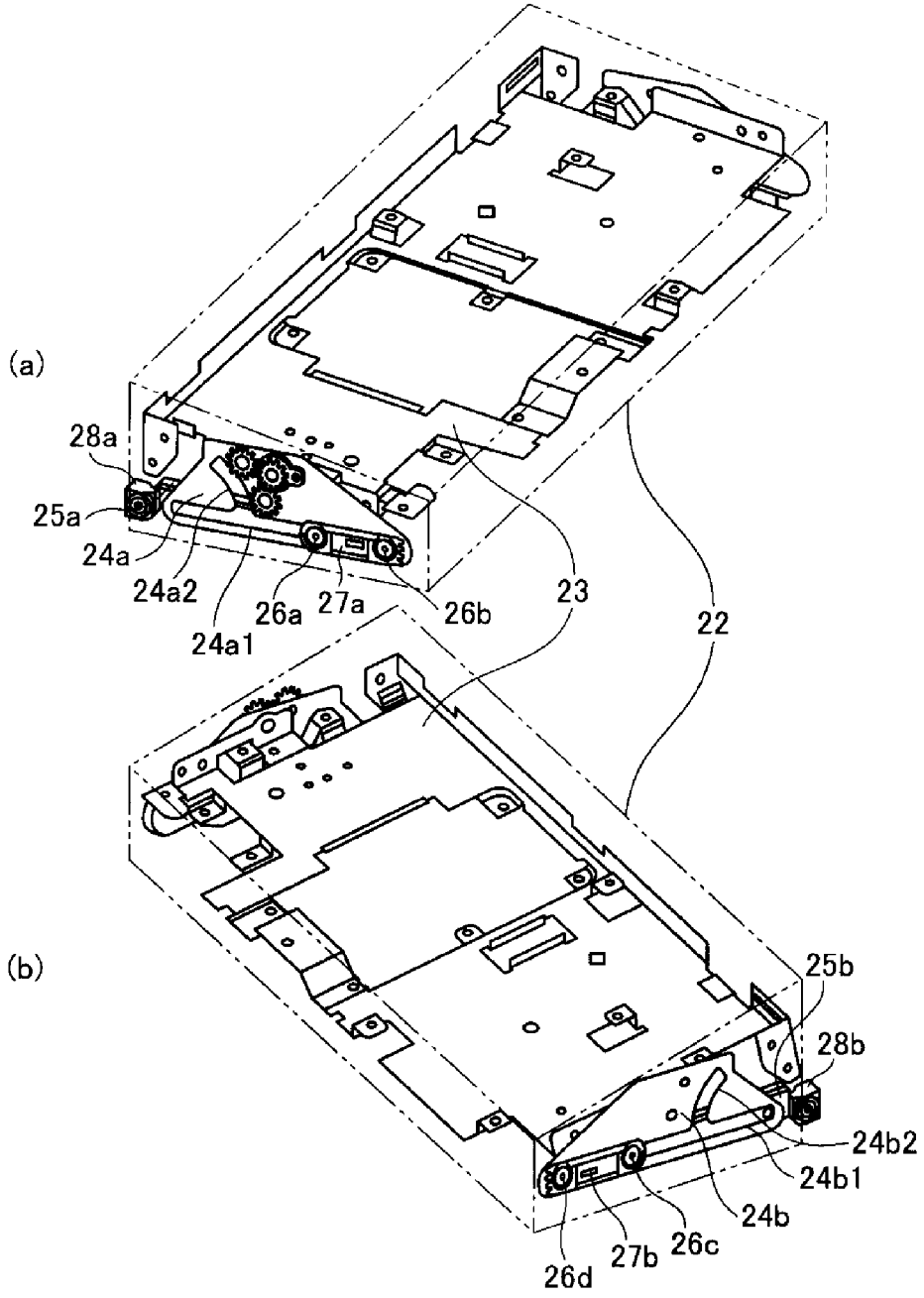

Parts (a) and (b) of FIG. 5 are perspective views showing an inside frame of the operating portion of the image forming apparatus in Embodiment 1 of the present invention.

Figure 6:
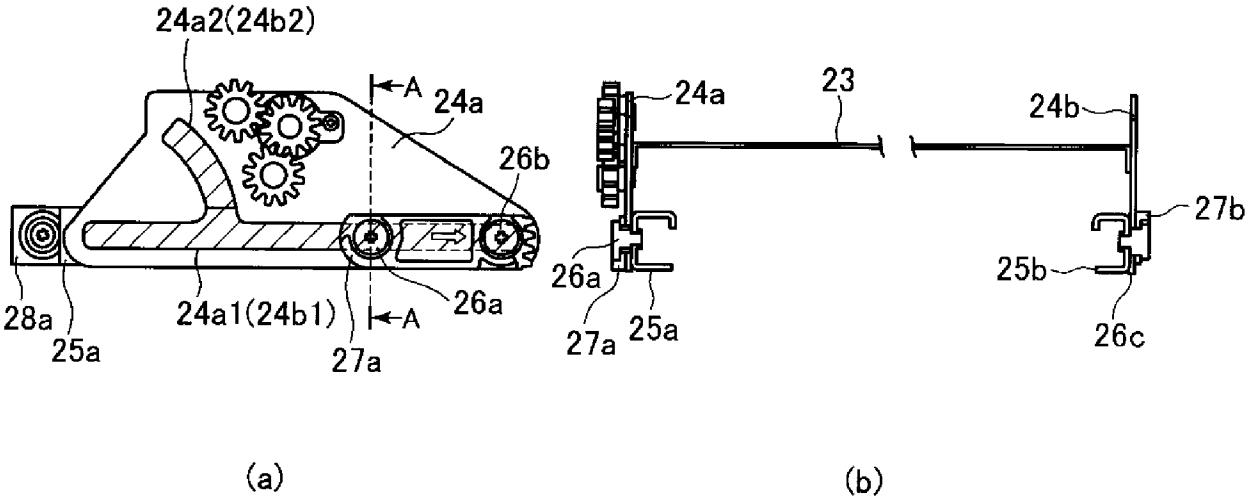

Parts (a) and (b) of FIG. 6 are schematic views of the inside frame of the operating portion of the image forming apparatus in Embodiment 1 of the present invention, in which (a) is a left side view, and (b) is a sectional view.

Figure 7:
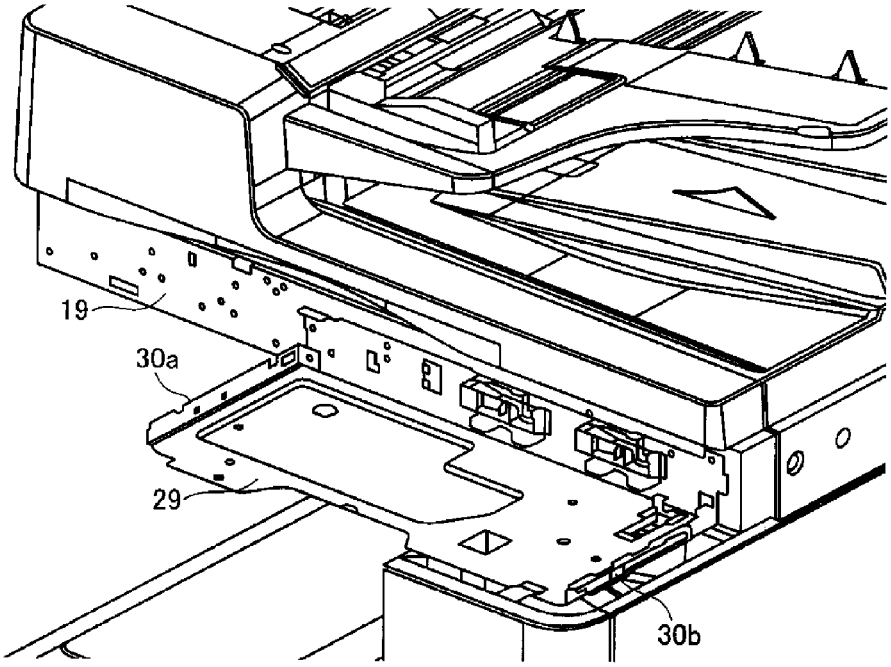

FIG. 7 is a perspective view of an under-operating portion stay of the image forming apparatus in Embodiment 1 of the present invention.

Figure 8:
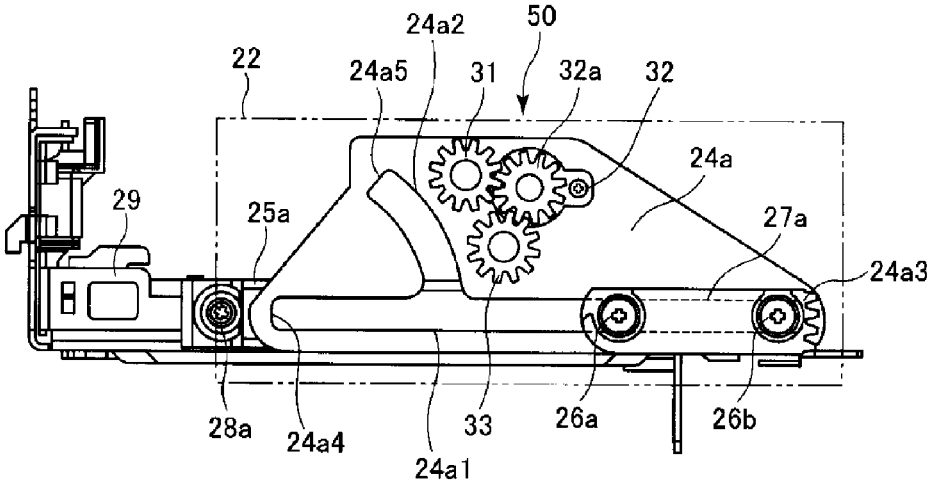

FIG. 8 is a left side view of an inside structure of the operating portion showing state in which the operating portion is retracted in Embodiment 1 of the present invention.

Figure 9:
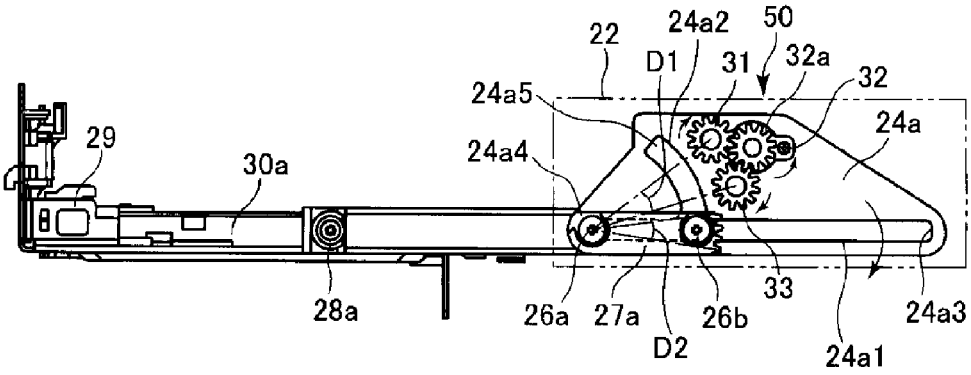

FIG. 9 is a left side view of the inside structure of the operating portion showing the state in which the operating portion is pulled out in the maximum length in Embodiment 1 of the present invention.

Figure 10:
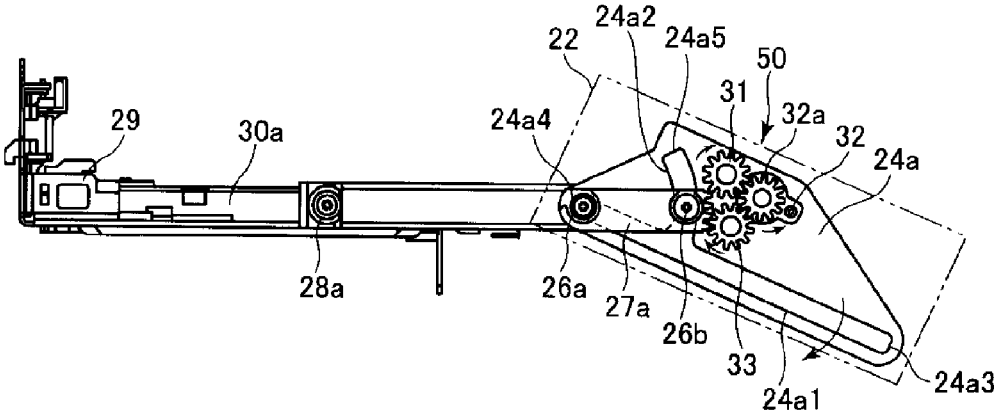

FIG. 10 is a left side view of the inside structure of the operating portion showing an intermediary state in which the operating portion is tilted in Embodiment 1 of the present invention.

Figure 11:
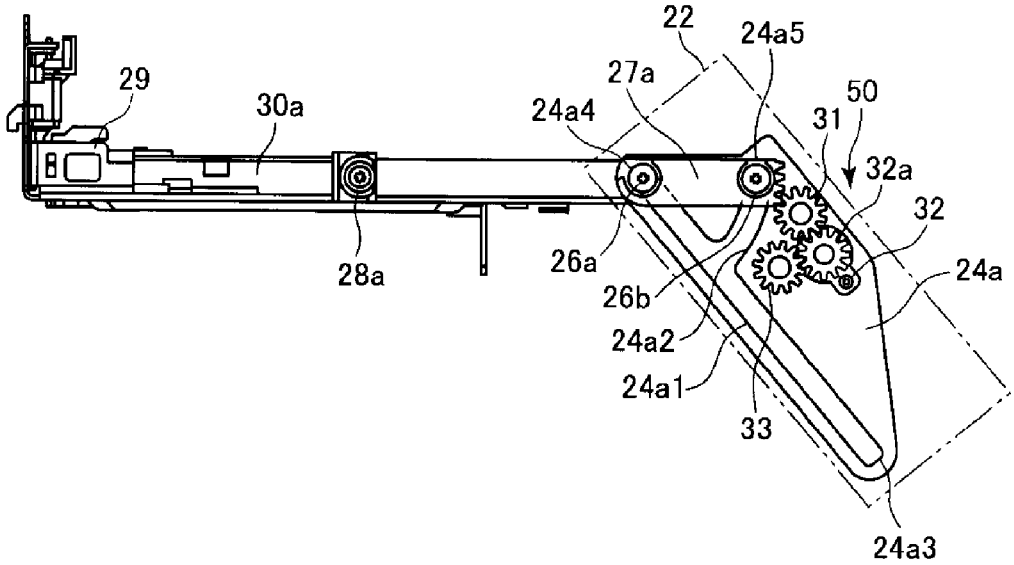

FIG. 11 is a left side view of the inside structure of the operating portion showing the state in which the operating portion is tilted until the maximum angle in Embodiment 1 of the present invention.

Figure 12:
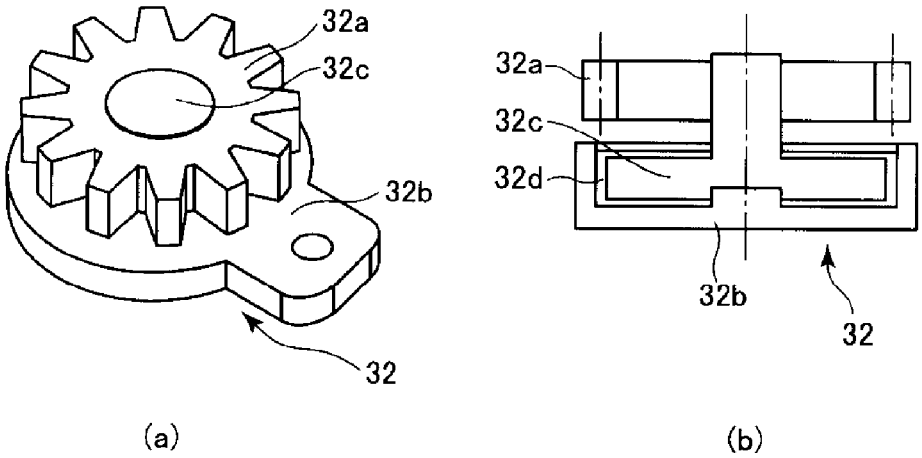

Parts (a) and (b) of FIG. 12 are schematic views for illustrating a structure of an oil damper, in which (a) is a perspective view, and (b) is a sectional view.

Figure 13:
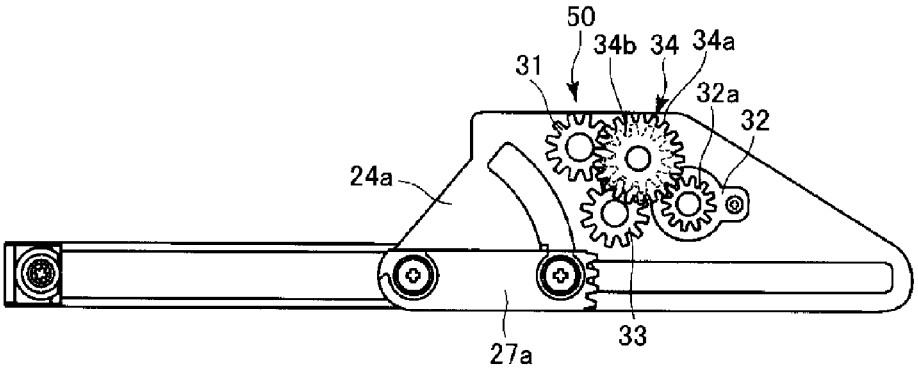

FIG. 13 is a left side view of the inside structure of the operating portion for illustrating an example in which (speed) reduction gears are used as a gear train of a damper mechanism.

Figure 14:
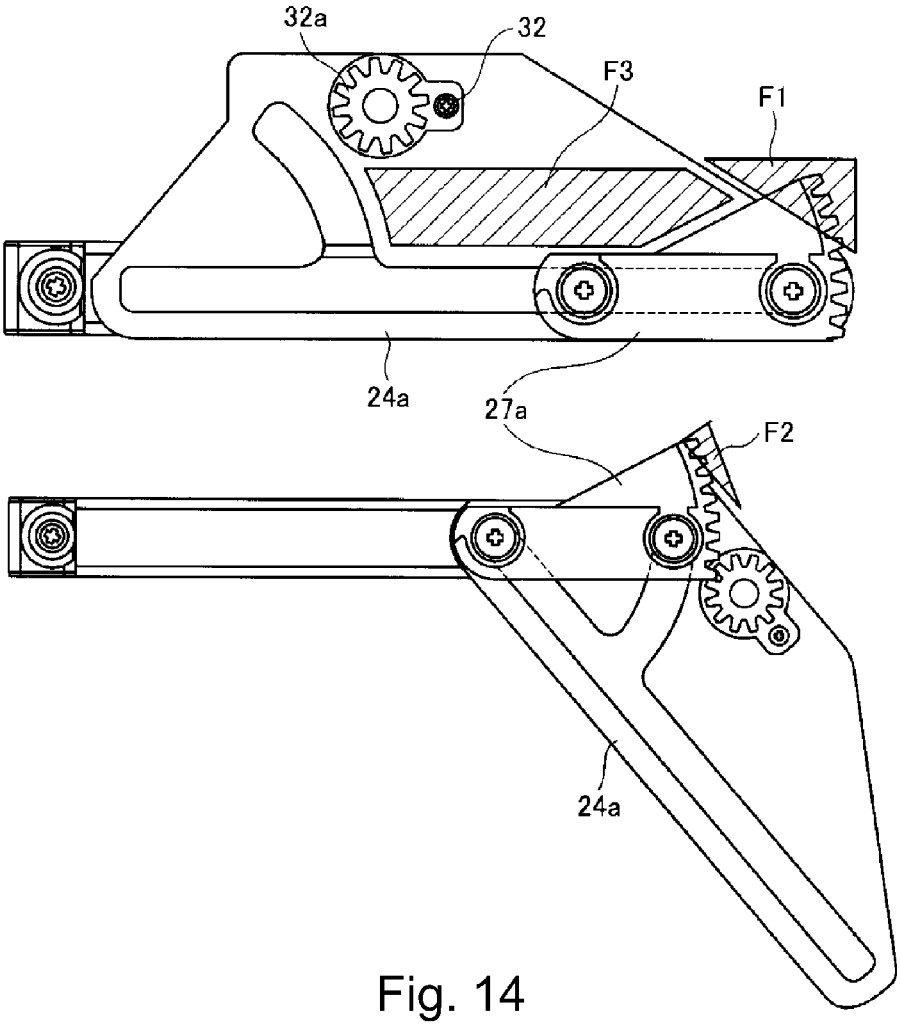

FIG. 14 includes left side views of an inside structure of an operating portion in a cam plate example.

Figure 15:
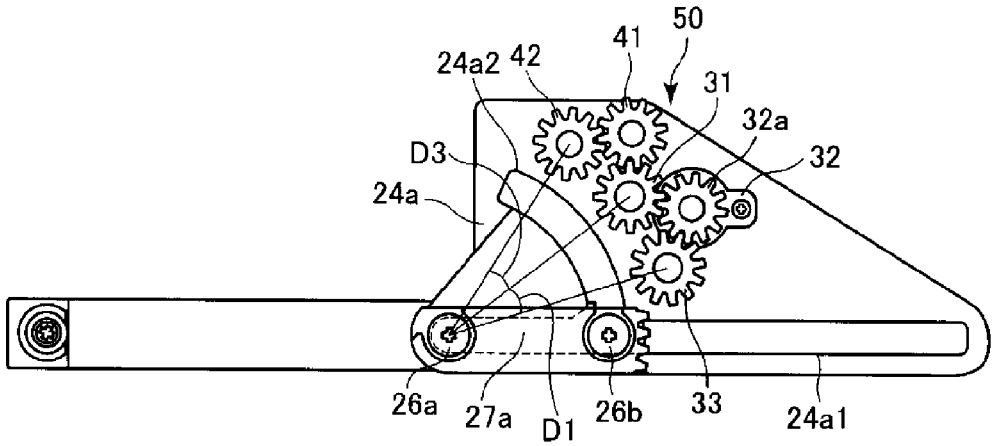

FIG. 15 is a left side view of the inside structure of the operating portion for illustrating the case where three second gears are provided in Embodiment 1 of the present invention.

Figure 16:
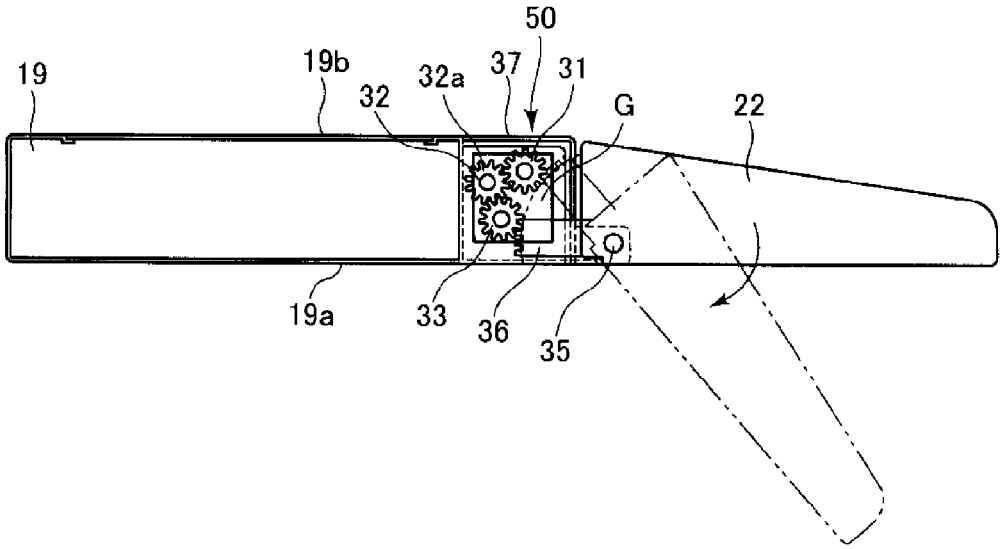

FIG. 16 is a left side view showing an inside structure of an operating portion of an image forming apparatus according to Embodiment 2 of the present invention.

Figure 17:
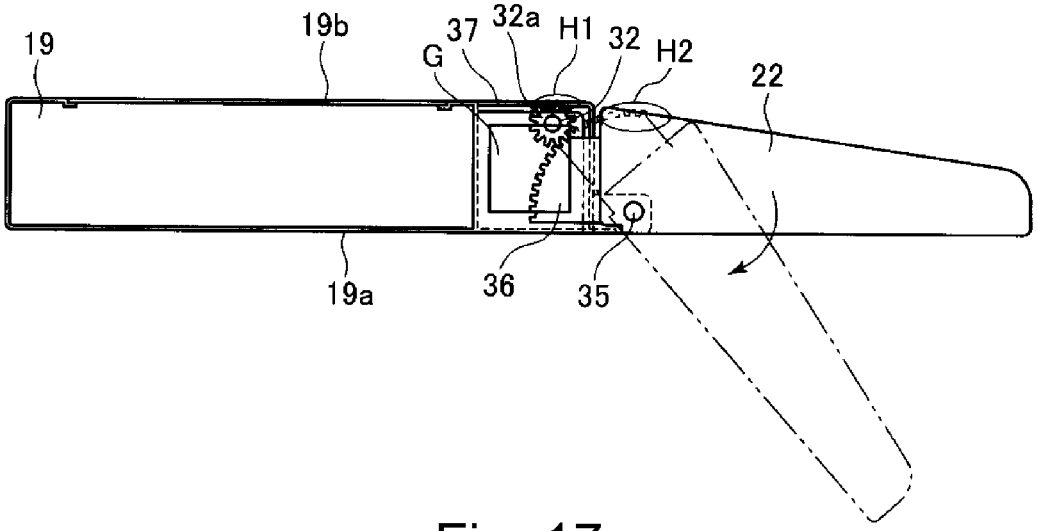
Figure 18:
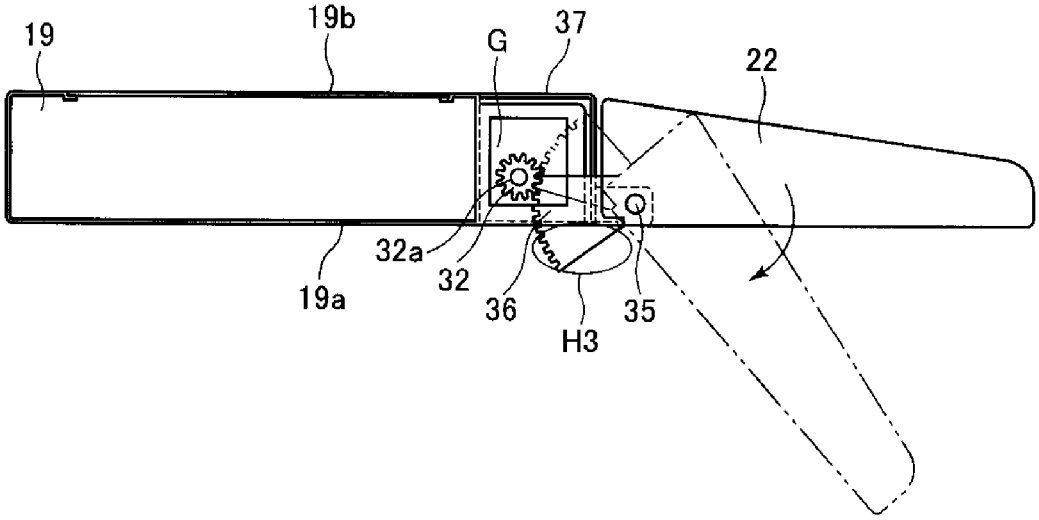

FIGS. 17 and 18 are left side views showing the inside structure of the operating portion in the cam plate example.

Figure 19:
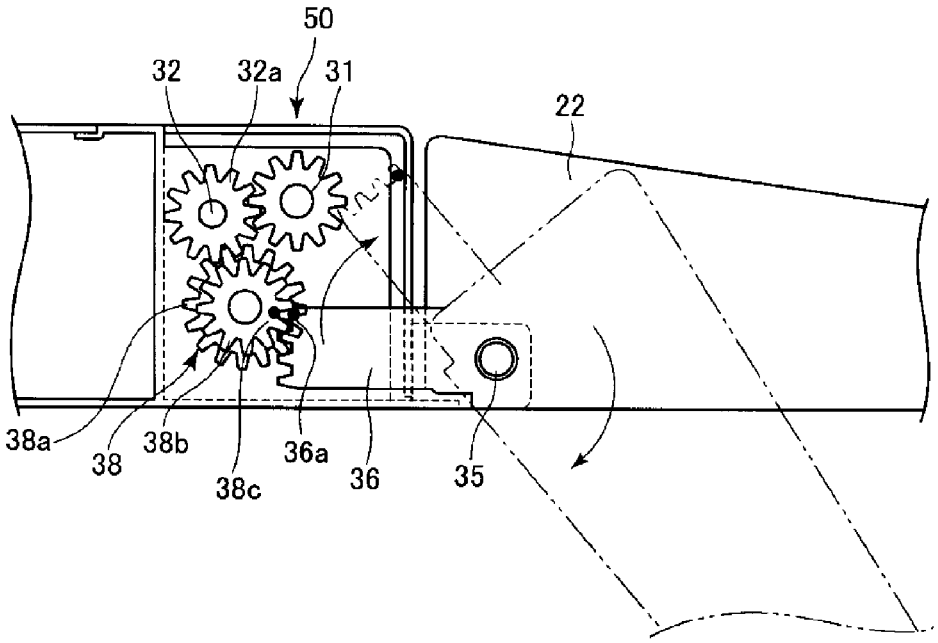

FIG. 19 is a left side view, of a principal portion of the inside structure of the operating portion, for illustrating a damper mechanism capable of controlling a torque.

Figure 20:
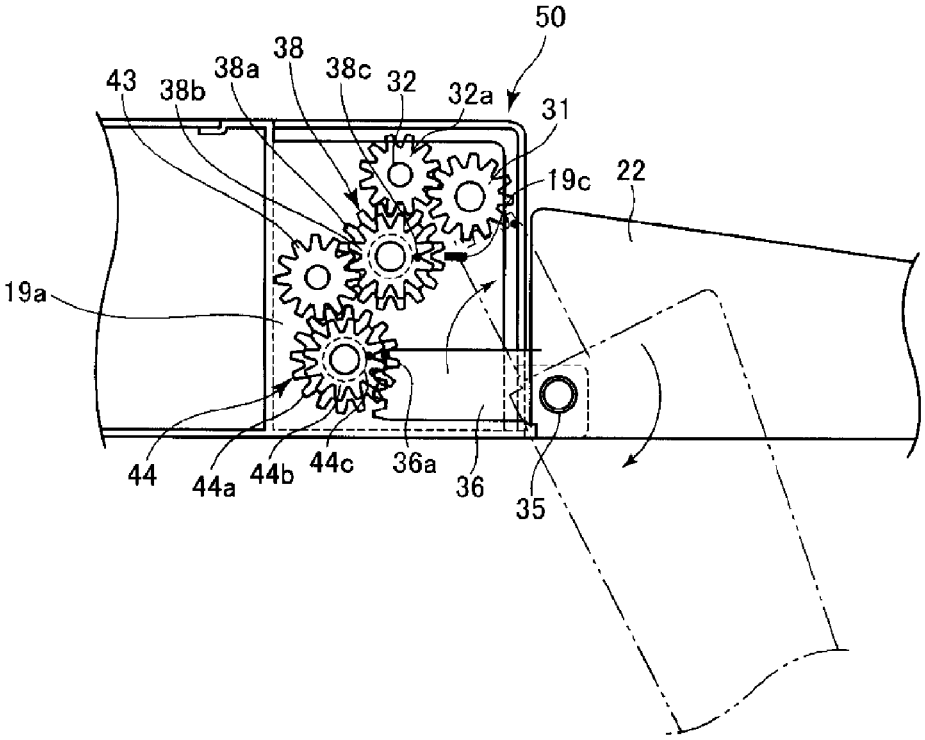

FIG. 20 is a left side view, of the inside structure of the operating portion, for illustrating a damper mechanism capable of switching a torque control level at three levels.

Figure 21:
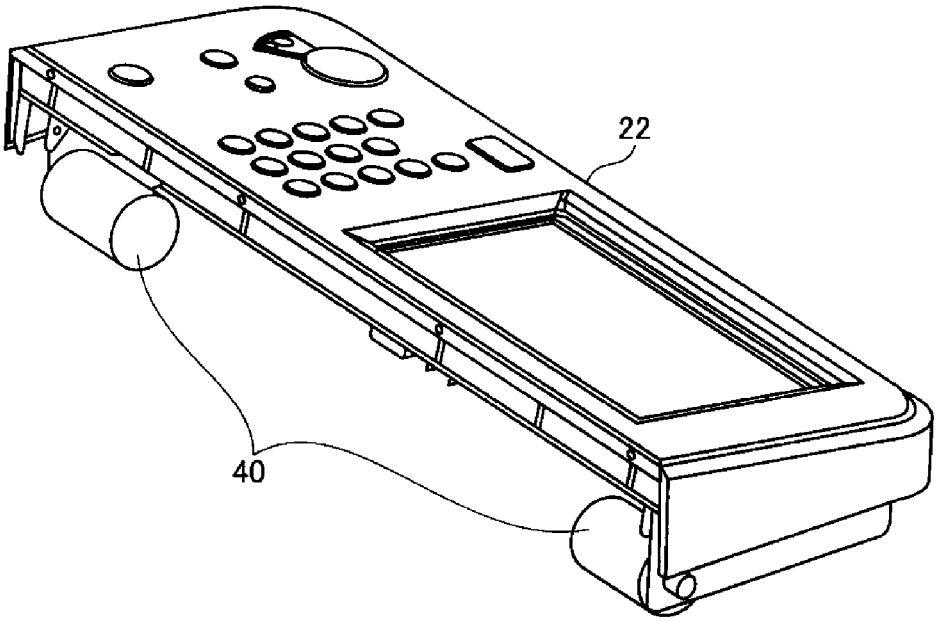

FIG. 21 is a perspective view, of a conventional operating portion for illustrating a tilting mechanism of the conventional operating portion.

DESCRIPTION OF THE PREFERRED EMBODIMENTS

An image forming apparatus according to the present invention will be specifically described below with reference to the drawings.

Embodiment 1

1. General Structure of Image Forming Apparatus

First, a general structure of the image forming apparatus in this embodiment according to the present invention will be described. The image forming apparatus in this embodiment is a full-color copying machine using an electrophotographic type. The present invention is not limited to the full-color copying machine but is applicable to an image forming apparatus such as a printer. Further, the present invention is not limited to the image forming apparatus of the electrophotographic type but may also be applied to an image forming apparatus of, e.g., an ink jet type well known to a person ordinarily skilled in the art.

Figure 1:
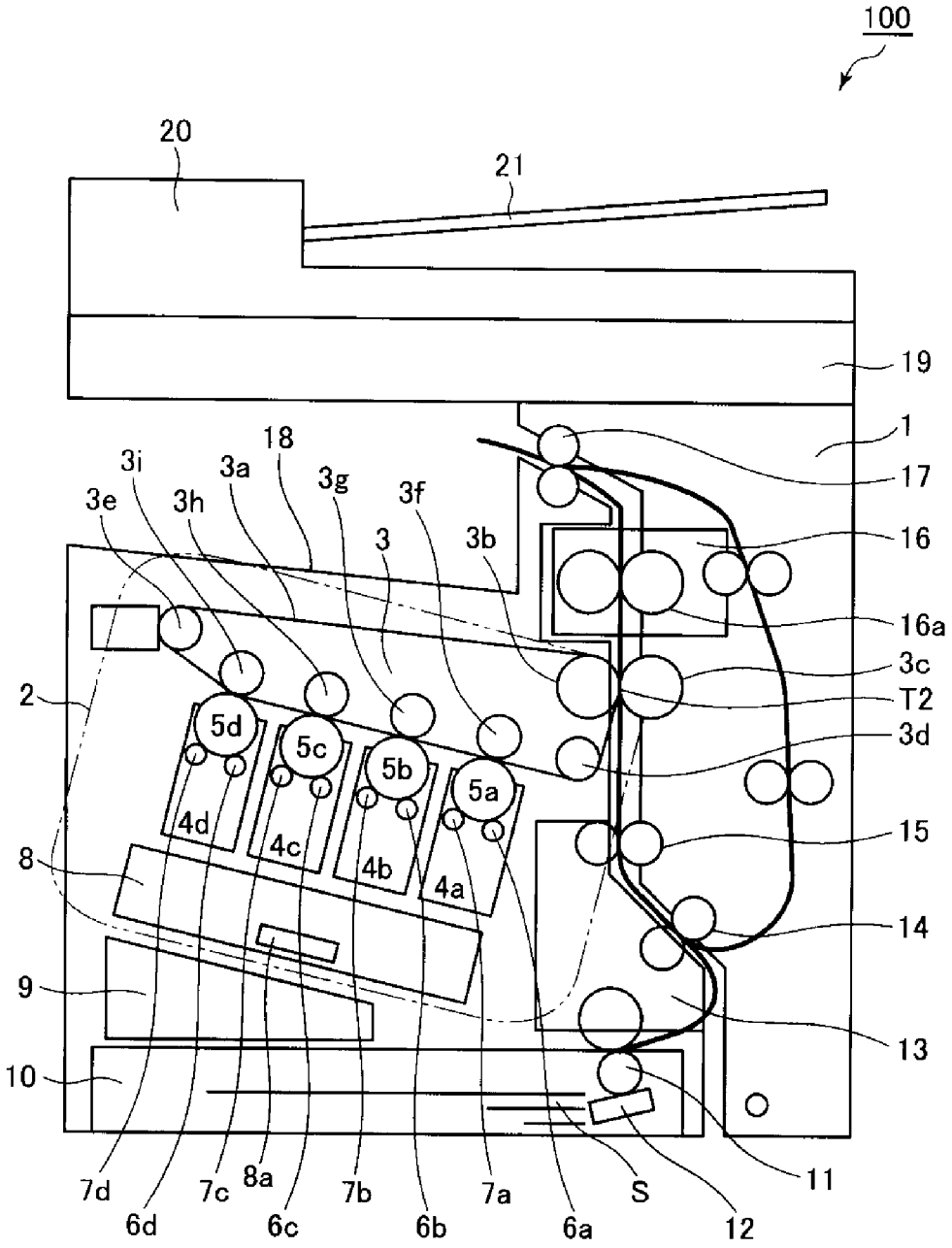
FIG. 1 is a sectional view showing a general structure of an image forming apparatus according to Embodiment 1 of the present invention.

FIG. 1 is a sectional view showing the general structure of an image forming apparatus 100. The image forming apparatus 100 includes an image forming portion 2 in an apparatus main assembly 1. The image forming portion 2 is provided substantially in parallel to a discharge tray 18 for stacking thereon discharged sheets S.

The image forming portion 2 includes a laser scanner 8 for exposing photosensitive drums 5*a*-5*d* to light on the basis of image information. Further, the image forming portion 2 includes four process cartridges 4*a*-4*d* for holding the photosensitive drums 5*a*-5*d*, charging devices 6*a*-6*d*, developing devices including developing rollers 7*a*-7*d*, and the like. Further, the image forming portion 2 includes an intermediary transfer member unit 3 including an intermediary transfer belt 3*a*, as an intermediary transfer member, for transferring (primary-transferring) toners from the photosensitive drums 5*a*-5*d* onto the intermediary transfer belt 3*a* and then for transferring (secondary-transferring) the toners from the intermediary transfer belt 3*a* onto a sheet (transfer material) S. The respective process cartridges 4*a*-4*d* form toner images of different colors (yellow, magenta, cyan and black, respectively) by using an electrophotographic system.

In this embodiment, above the laser scanner 8, the cartridges 4*a*-4*d* are provided, and on the cartridges 4*a*-4*d*, the intermediary transfer member unit 3 is provided. Each of these members is disposed substantially in parallel to a discharge tray 18.

Above the intermediary transfer member unit 3, a fixing device 16 for fixing the toner images transferred on the sheet S, a discharging portion 17 for discharging the sheet S onto the discharge tray 18, and the like are provided.

Further, below the laser scanner unit 8, a sheet feeding cassette 10, a feeding portion 13 for feeding the sheet S, and the like are provided.

Further, in a dead space, which is substantially a triangle in cross section, sandwiched between the laser scanner 8 and the sheet feeding cassette 10, a power source 9 is provided.

2. Image Forming Operation

First, a sheet feeding roller 11 is rotated in the counterclockwise direction in FIG. 1, so that sheets S in the sheet feeding cassette 10 are separated one by one by a sheet separating unit 12 which contacts the sheet feeding roller 11, thus being sent to a conveying roller pair 14 and a registration roller pair 15. A leading end of the sheet S abuts against the registration roller pair 15 which rotation is stopped, and thus is once stopped, so that the sheet S forms a loop. As a result, oblique movement of the sheet S is corrected so that the leading end of the sheet S properly contacts the registration roller pair 15.

Thereafter, synchronization between rotation of the intermediary transfer belt 3*a* and an image writing position is achieved, and then the sheet S is conveyed to a secondary transfer portion T1 by rotation of the registration roller pair 15.

On the other hand, the process cartridges 4*a*-4*d* are successively driven in synchronism with printing timing, and depending on the drive, the associated one of the photosensitive drums 5*a*-5*d* is rotated in the clockwise direction in FIG. 1. Further, when a polygonal mirror 8*a* of the laser scanner 8 starts its rotation, the charging devices 6*a*-6*d* impart uniform electric charges to peripheral surfaces of the photosensitive drums 5*a*-5*d*. The laser scanner 8 exposes the peripheral surfaces of the photosensitive drums 5*a*-5*d* to light depending on an image signal, so that electrostatic latent images are formed on the photosensitive drums 5*a*-5*d*. Then, the developing rollers 7*a*-7*d* in the respective developing devices transfer the toners onto low-potential portions of the electrostatic images, so that the toner images are formed on the peripheral surfaces of the photosensitive drums 5*a*-5*d*.

The intermediary transfer belt 3*a* of the intermediary transfer member unit 3 is extended and stretched by a driving roller 3*b*, an idler roller 3*d* and a tension roller 3*e* and is driven by the driving roller 3*b* in the counterclockwise direction in FIG. 1. Primary transfer rollers 3*f*-3*i* contacting the intermediary transfer belt 3*a* toward the respective photosensitive drums 5*a*-5*d* are rotated in the counterclockwise direction in FIG. 1 by friction with the intermediary transfer belt 3*a*.

A voltage is applied to each of the primary transfer rollers 3*f*-3*i*, so that by electric fields formed between the photosensitive drums 5*a*-5*d* and the primary transfer rollers 3*f*-3*i*, the toner images are successively transferred from the photosensitive drums 5*a*-5*d* onto the intermediary transfer belt 3*a*.

The four color toner images transferred on the intermediary transfer belt 3*a* reach the secondary transfer portion T2 where a secondary transfer roller 3*c* contacts the intermediary transfer belt 3*a* toward the driving roller 3*b*. Then, the toner images are attracted toward the secondary transfer roller 3*c* by an electric field generated by a voltage applied to the secondary transfer roller 3*c* and therefore are transferred onto the sheet S conveyed to the secondary transfer portion T2.

The sheet S on which the four color toner images are transferred is separated from the intermediary transfer belt 3 by curvature of the driving roller 3*b* and then is conveyed to the fixing device 16. The sheet S is subjected to application of heat and pressure while being conveyed by a fixing roller pair 16*a* in the fixing device 16. As a result, the toner images of a plurality of colors are fixed on the surface of the sheet S.

Thereafter, the sheet S is discharged to the outside of the apparatus main assembly 1 by the discharging roller pair 17 and thus is stacked on the discharge tray 18.

Figure 2:
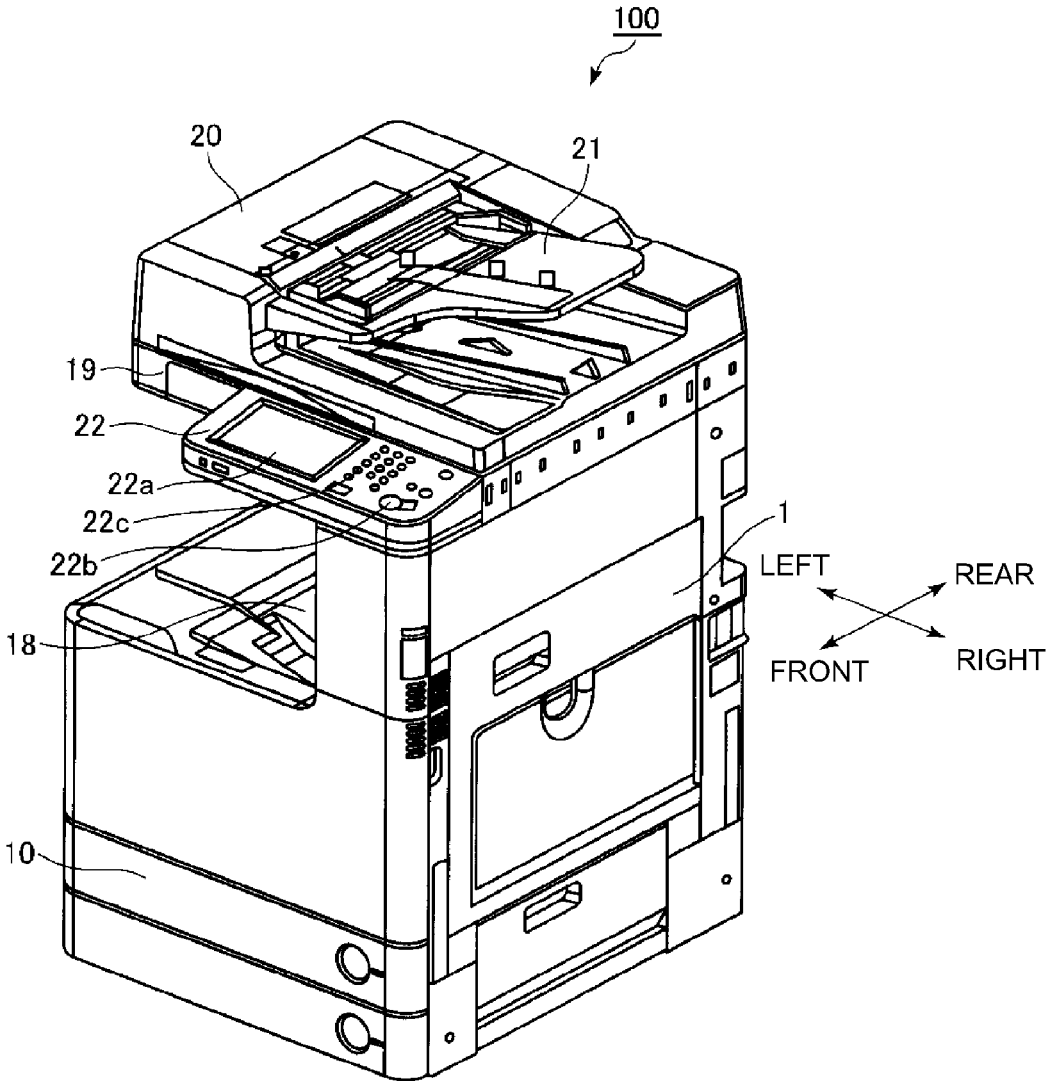
FIG. 2 is a perspective view of the image forming apparatus in Embodiment 1 of the present invention.

FIG. 2 is a perspective view of the image forming apparatus 100. Here, as shown in FIG. 2, a side where an operating portion 22 is provided (a front side on the drawing sheet of FIG. 1) is a "front side (front surface)" of the image forming apparatus 100 and its opposite side (a rear side on the drawing sheet of FIG. 1) is a "rear side (rear surface)". Left and right of the image forming apparatus 100 in the case where the image forming apparatus 100 is viewed from the front side are left (side or surface) and right (side or surface) of the image forming apparatus 100. Further, with respect to the image forming apparatus 100, upper and lower are upper (side or surface) and lower (side or surface) during an operation of the image forming apparatus 100 and correspond to those with respect to a vertical direction in general. The front side of the image forming apparatus 100 is generally a side where an operator operates the image forming apparatus 100.

At an upper portion of the apparatus main assembly 1, a scanner 19 for reading an image and an automatic original feeding unit (device) 20 are provided, and in front of the scanner 19, the operating portion 22 is disposed.

When the original is copied, the original is set on an original tray 21 of the automatic original feeding device 20 or is set on an original reading surface (glass surface) of the scanner after opening a space on the scanner 19 by raising the automatic original feeding device 20. The automatic original feeding device 20 separates sheets, one by one, of the original placed on the original tray and then passes the original through the reading surface, so that the scanner 19 scans the original.

At the operating portion 22, pieces of information on a monochromatic/color (image) reading mode, an output size of copy, the type of the sheet S and the print number (of copy) are inputted. Then, when a start key 22 is pressed down at the operating portion 22, the original is optically read by the scanner 19 and is converted into image data. On the basis of this image data, as described above, the toner images are transferred and fixed on the sheet S, thus being stacked as a recorded image on the (sheet) discharge tray 18.

3. Rotatable (Movement) Unit

The present invention is applicable to a unit (rotatable unit) which is provided and rotatable in the apparatus main assembly 1 of the image forming apparatus 100 but in this embodiment, the case where the present invention is applied to the operating portion 22 which is tiltable is described as an example.

As shown in FIG. 2, the operating portion 22 is disposed at an upper front portion of the apparatus main assembly 1. At the operating portion 22, a liquid crystal display portion 22*a* for displaying an operating state of the image forming apparatus 100 is provided. Further, at the operating portion 22, various keys such as the start key for starting copying and ten key (numeric keys) 22*c* for inputting the print number, a fax number and the like are provided.

The operating portion 22 is, in general, as shown in FIG. 2, retracted (disposed) at a position close to the scanner 19 but is provided with a slideable and tiltable mechanism so as to facilitate operation by shorter people or wheel chair users.

Figure 3:
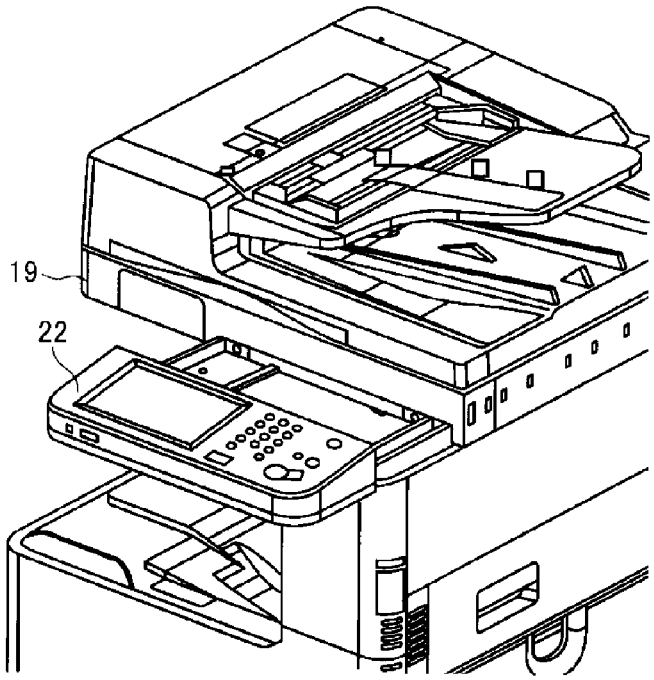
FIG. 3 is a perspective view showing a state in which an operating portion of the image forming apparatus is pulled out in a maximum length in Embodiment 1 of the present invention.
Figure 4:
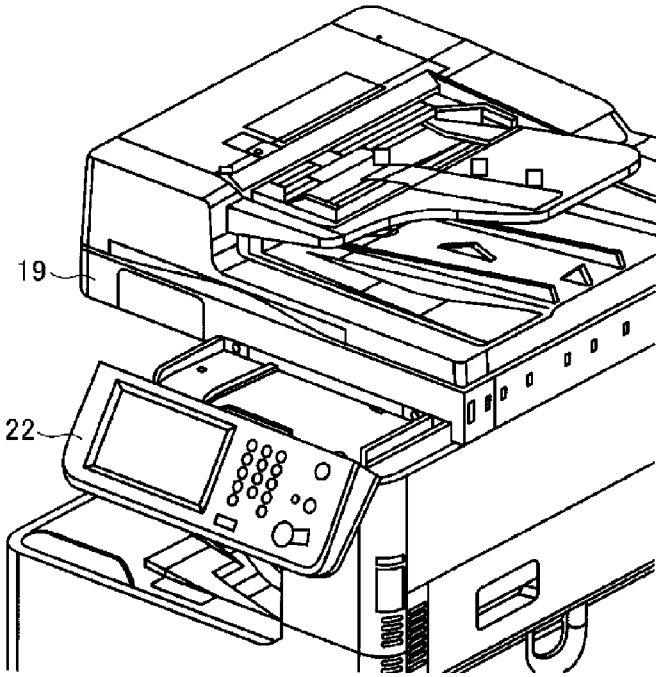
FIG. 4 is a perspective view showing a state in which the operating portion of the image forming apparatus is tilted until a maximum angle in Embodiment 1 of the present invention.

When the operating portion 20 is pulled frontward, the operating portion 22 sides substantially horizontally. When the operating portion 22 is pressed down at the time of a maximum pulled-out state (FIG. 3), the operating portion is rotated (rotationally moved) about its rear side as a (rotation) center, so that the operating portion 22 can be held at an arbitrary angle until a maximum tilt state (FIG. 4) in which the operating portion 22 is tilted from the horizontal state by about 50 degrees. Accordingly, the direction of an operating surface (where the liquid crystal display portion 22*a* and the various keys are disposed) of the operating portion 22 is adjustable at an angle where the operating portion 22 is easy to use by the user. Thus, in this embodiment, the rotatable unit is the operating portion 22, capable of rotating its operating surface toward the side where the operating surface is operated, for operating the image forming apparatus 100.

4. Slideable and Tiltable Mechanism of Operating Portion

Parts (a) and (b) of FIG. 5 are perspective views showing an inside frame 23 of the operating portion 22, in which (a) is the perspective view as seen from a left-side surface side, and (b) is the perspective view as seen from a right-side surface side. Part (a) of FIG. 6 is a left side view of the frame 23, and (b) of FIG. 6 is a sectional view of the frame 23 taken along A-A line in (a) of FIG. 6.

On the frame 23 fixed inside the operating portion 22, cam plates 24*a* and 24*b*, which are a plate-like cam member as a rotatable member, are fixed at left and right side surfaces, respectively. The cam plates 24*a* and 24*b* are the same-shaped member such that linear slits 24*a*1 and 24*b*1 as a first groove portion and arcuate slits 24*a*2 and 24*b*2 as a second groove portion are provided as indicated by hatched lines in (a) of FIG. 6. The arcuate slits 24*a*2 and 24*b*2 are formed in an arcuate shape, with a center at a first end portion which is one of end portions of the associated one of the linear slits 24*a*1 and 24*b*1, so as to merge with the linear slits 24*a*1 and 24*b*1, respectively.

Inside the left-side cam plate 24*a*, a rail 25*a* extending in a front-rear direction of the apparatus main assembly 1 is provided, and two stepped screws 26*a* and 26*b* fixed at two positions as first and second projections to the rail 25*a* are engaged movably along the linear slit 24*a*1 of the cam plate 24*a*. Outside the cam plate 24*a*, a slide gear 27*a* is provided, and two holes provided at two positions in the slide gear 27*a* are engaged with the stepped screws 26*a* and 26*b*, respectively, and are held between the cam plate 24*a* and screw heads of the stepped screws 26*a* and 26*b*.

Similarly, inside the right-side cam plate 24*b*, a rail 25*b* extending in a front-rear direction of the apparatus main assembly 1 is provided, and two stepped screws 26*c* and 26*d* fixed at two positions to the rail 25*b* are engaged with the linear slit 24*b*1 of the cam plate 24*b*. Outside the cam plate 24*b*, a slide gear 27*b* is provided, and two holes provided at two positions in the slide gear 27*b* are engaged with the stepped screws 26*c* and 26*d*, respectively, and are held between the cam plate 24*b* and screw heads of the stepped screws 26*c* and 26*d*.

The left-side slide gear 27*a* is a sector gear described later and has a function of preventing disengagement of the cam plate 24*a* when the cam plate 24*a* slides on the rail 25*a*. The right-side slide gear 27*b* is not required to be the sector gear but in this embodiment the same part is common to these slide gears 27*a* and 27*b* in order to suppress a cost of a metal mold by commonality of the parts.

As described above, the slide gear 27*a* slides on the rail 25*a* along the linear slit 24*a*1 in a state in which the cam plate 24*a* is sandwiched between the rail 25*a* and the slide gear 27*a*. This is similarly true for the rail 25*b* side.

On the other hand, as shown in FIG. 7, on the scanner 19, an under-operating portion stay 29 as a fixing portion is fixed, and at left and right side surfaces of the stay 29, guide members 30*a* and 30*b* for guiding the operating portion 22 in the front-rear direction of the apparatus main assembly 1 are provided. With these guide members 30*a* and 30*b*, the rails 25*a* and 25*b* of the operating portion 22 are engaged, respectively.

Therefore, the operating portion 22 slides in the front-rear direction in two stages. In the first stage, slide by engagement of the rails 25*a* and 25*b* with the guide members 30*a* and 30*b* provided on the under-operating portion stay 29 is effected. In the second stage, slide by engagement of the linear slit 24*a*1 of the left-side cam plate 24*a* with the stepped screws 26*a* and 26*b* provided at the two positions to the rail 25*a* and by engagement of the linear slit 24*b*1 of the right-side cam plate 24*b* with the stepped screws 26*c* and 26*d* provided at the two positions to the rail 25*b* is effected.

FIGS. 8 and 9 are left side views showing inside structures of the operating portion 22 when the operating portion 22 is retracted (normal state) and is placed in a maximum pulled-out state, respectively.

In the following, operations of the left and right rails 25*a* and 25*b* and the like of the operating portion 22 are the same, and therefore only the operations in the left side will be described and the operations in the right side will be omitted from description.

When the operating portion 22 is retracted, as shown in FIG. 8, the rail 25*a* and the cam plate 24*a* are located in the rear side (left side in FIG. 8) of the apparatus main assembly 1. In this case, a front-side end portion 24*a*3 of the linear slit 24*a*1 contacts the front-side stepped screw 26*b* fixed to the rail 25*a*.

When the operating portion 22 is pulled out, the rail 25*a* slides in the substantially horizontal direction relative to the under-operating portion stay 29 by the guide member 30*a* and stops when a stopper 28*a* provided in the rear side of the rail 25*a* contacts a projection (not shown) provided at a front-side end portion of the guide member 30*a*. At this time, the direction of the linear slit 24*a*1 of the cam plate 24*a* is regulated by the slide gear 27*a* and the stepped screws 26*a* and 26*b* and thus the linear slit 24*a*1 is disposed substantially horizontally. As a result, the frame 23 and the operating portion 22 are disposed substantially horizontally.

When the operating portion 22 is further pulled out, by the linear slit 24*a*1 provided in the cam plate 24*a*, the cam plate 24*a* is moved to the front side (right side) of the apparatus main assembly 1. Then, the operating portion 22 is stopped at a position where a rear-side end portion 24*a*4 of the linear slit 24*a*1 contacts the rear-side stepped screw 26*a* fixed to the rail 25*a* (maximum pulled-out state in FIG. 9).

When the operating portion 22 is in the maximum pulled-out state, as shown in FIG. 9, regulation (limitation) at the upper portion of the front-side stepped screw 26*b* is eliminated by the arcuate slit 24*a*2 provided in the cam plate 24*a*, so that the cam plate 24*a* is rotated about the rear-side stepped screw 26*a* as a (rotation) center (FIG. 10). Then, the operating portion 22 is stopped at a position where the front-side stepped screw 26*b* contacts an end portion 24*a*5 of the arcuate slit 24*a*2 (maximum tilted state in FIG. 11).

5. Damper Mechanism

Next, a damper mechanism 50, according to the present invention, provided to the tilt mechanism of the operating portion 22 will be described.

The damper mechanism 50 in this embodiment is roughly constituted by providing the sector gear at the rotation (movement) center of the operating portion 22 as the rotatable unit and by providing a plurality of small gears directly engageable with the sector gear so as to be connected with a damper gear.

In one or both sides of the cam plates 24*a* and 24*b* provided at the left and right side surfaces of the frame 23, a gear train constituted by the plurality of gears of the damper mechanism 50 can be provided. In the case where the gear train is provided in only one side, the gear train may preferably be provided in a side where the gear train is close to the center of gravity or in a side where an urging force is applied to the gear train during operation. In this embodiment, the liquid crystal display portion 22*a* which is heavy and on which a touch panel is mounted is disposed at a left-side portion of the operating portion 22 and therefore the gear train is provided on the left-side cam plate 24*a*.

As shown in FIG. 9, on the cam plate 24*a*, three gears 31, 32*a* and 33 are provided. These gears 31, 32*a* and 33 are rotatably held by the cam plate 24*a*. In this embodiment, the gears 31 and 33 are a plurality of second gears directly engageable with the slide gear 27*a* as a first gear (first drive transmission member) described later. The gear 31 is the gear as a second drive transmission member, and the gear 33 is the gear as a third drive transmission member. In this embodiment, each of the gears 31, 32*a* and 33 is a module and has 12 teeth in the number of teeth.

The gear 32*a* is a gear (damper gear) of an oil damper 32 engageable with the gears 31 and 33. The operating portion 32 is constituted, as shown in FIG. 12, by including the damper gear 32*a* as a connecting portion, a damper case 32*b* as a casing, a rotor 32*c* as a rotatable portion, and a silicone oil 32*d* as a resistance generating portion (resistance generating member). The oil damper 32 generates a resistance (torque) against rotational motion of the plurality of second gears by subjecting the rotor 32*c* integrally provided with the gear 32*a* to a damping (braking) force generated by viscosity resistance of the silicone oil 32 injected into the damper case 32*b*. In this embodiment, a resistance generating means is constituted by the damper gear 32. The gears 31 and 33 are connected to the common resistance generating means by the damper gear 32*a*. Incidentally, the damper mechanism can also be regarded as an integral damper mechanism consisting of the damper gear 32*a* and other members 32*b* to 32*d*. Further, the damper gear 32*a* is regarded as a driving connection member for connecting drive of the gears 31 and 33, and thus the members 32*b* to 32*d* which exert rotational load on the damper gear 32*a* can be collectively regarded as the damper mechanism.

Incidentally, the resistance generating means may only be required that it can generate the resistance (torque) as described above, and may also be, e.g., a torque limiter.

The gears 31 and 33 have the same number of teeth and are disposed so that a center of each of the gears 31 and 32 is positioned on a circumference of concentric circles with the same center as the rotation center of the rear-side stepped screw 26*b* when the operating portion 22 is in the maximum pulled-out state (concentric circle relationship). Thus, the gears 31 and 33 are disposed along a circumferential direction of the arcuate slit 24*a*2, i.e., along the rotation direction of the slide gear 27*a* with respect to the cam plate 24*a*. Here, the concentric circle relationship is not limited to a complete concentric circle relationship. The concentric circle relationship may only be required that each of the plurality of second gears can be engaged with the first gear to obtain a desired effect in this embodiment when the first gear is rotationally moved relative to the plurality of the second gears. For example, in this embodiment (also the same as in other embodiments), when a deviation amount of the center, from the concentric circle, between the second gears with respect to a radial direction of the concentric circle is within 1 mm (corresponding to dimensional tolerance), the concentric circle relationship can be regarded as being satisfied.

The gear 33 is disposed at a position where the gear 33 does not interfere with the slide gear 27*a* when the slide gear 27*a* slides in the horizontal direction. Further, the gear 31 is disposed so that when the operating portion 22 is in the maximum pull-out state, an angle formed between a rectilinear line connecting the center of the slide gear 27*a* and the center of the gear 31 and a rectilinear line connecting the center of the slide gear 27*a* and the center of the gear 33 is 22.5 degrees.

The slide gear 27*a* is the sector gear and is a module using a gear portion corresponding to 4 teeth of a gear having 72 teeth. The gear portion (4 teeth) provided at the arcuate portion of the slide gear 27*a* functions as a drive transmission portion. An angle corresponding to one tooth of the slide gear 27*a* is 5 degrees and therefore an angle D2 corresponding to the 4 teeth of the slide gear 27*a* is 20 degrees. In this embodiment, the slide gear 27*a* as the sector gear is the first gear concentrically with the rotation center of the operating portion 22 as the rotatable unit. Here, the term "concentrically" between the first gear and the rotatable unit is not limited to "completely concentrically". The term "concentrically" may only be required that with rotational movement of the rotatable unit, the first gear is rotationally moved relative to the plurality of second gears provided in the apparatus main assembly side or in the rotatable unit side and is engageable with each of the second gears to obtain a desired effect in this embodiment. For example, in this embodiment (also the same as in other embodiments), when a deviation amount between the rotation center of the rotatable unit and the center of the first gear with respect to a radial direction is within 1 mm (dimensional tolerance), the term "concentrically" can be regarded as being satisfied.

The above-described angle D1 (22.5 degrees) is an angle corresponding to 4.5 teeth of the slide gear 27*a*. In order to smoothly switch the drive of the gear 33 to the drive of the gear 31 by the slide gear 27*a* during the tilt of the operating portion 22, a difference between the angles D1 and D2 may desirably be within an angle corresponding to one tooth of the slide gear 27*a*, i.e., an angle of 5 degrees or less.

When the operating portion 22 is placed in the maximum pulled-out state and then starts its rotational movement, the gear 33 starts engagement with the slide gear 27*a*, so that the gear 33 is rotated in the clockwise direction indicated by an arrow in FIG. 9. The damper gear 32*a* is always engaged with the gear 33 and therefore is rotated in the counterclockwise direction indicated by an arrow in FIG. 9. Similarly, the gear 31 which is always engaged with the damper gear 32*a* is rotated in the clockwise direction indicated by an arrow in FIG. 9. Thus, the second gears are drive-connected with each other, thus being typically rotated in the same direction in synchronism with each other.

When the operating portion 22 is further rotated, as shown in FIG. 10, the gear 31 start engagement with the slide gear 27*a* before the gear 33 is separated from the slide gear 27*a*.

The gear 31 is driven by the slide gear 27*a* via the damper gear 32*a* and the gear 33 and therefore always starts the engagement at the same phase. Accordingly, the gear 31 is smoothly engageable with the slide gear 27*a*. For that reason, an occurrence of an inconvenience of drive transmission due to phase shift of the gear is prevented.

The slide gear 27*a* is engaged with either of the gears 31 and 33 during the rotational movement and therefore, a torque for driving the damper gear 32*a* of the oil damper 32 via the both gears is generated.

When the front-side stepped screw 26*b* contacts the end portion 24*a*5 of the arcuate slit 24*a*2 of the cam plate 24*a*, the operating portion 22 is stopped (maximum tilted state in FIG. 11).

In the case where the state of the operating portion 22 is returned from the maximum tilted state, the gears 31, 32*a* and 33 rotated in the directions opposite to the above-described directions. The gear 33 is driven by the slide gear 27*a* via the gears 31 and 32*a* and therefore starts engagement always at the same phase. Accordingly, the gear 33 is smoothly engageable with the slide gear 27*a*.

A torque generated by the self-weight of the operating portion 22 and by an urging force for tilting the operating portion 22 and a torque required for driving the gear 32*a* of the oil damper 32 by the slide gear 27*a* via the gear 31 or the gear 33 are compared, and in the case where the former is large, the operating portion 22 is rotated. On the other hand, in the case where the latter is large, the operating portion 22 is held in a self-standing state.

When the operating portion 22 is stopped and used at a free angle, there is a need to make the torque for driving the oil damper 32 sufficiently larger than the self-weight of the operating portion 22 and the urging force for pressing down a button by the operator (user).

As described above, in this embodiment, the rotatable member (cam plate) 24*a* is provided in the rotatable unit side. This rotatable member 24*a* includes the first gear 24*a*1 formed in the linear shape. Further, the rotatable member 24*a* includes the second groove portion 24*a*2 formed in the arcuate shape so that it merges with the first groove portion 24*a*1 and so that the first end portion 24*a*4 of the first groove portion 24*a*1 is a radial center of the arcuate portion. Further, on the rotatable member 24*a*, the second gears 31 and 33 and the resistance generating means 32 are disposed. Further, in this embodiment, the first and second projections 26*a* and 26*b* which are movable in the first groove portion and which are fixed to the first gear 27*a* are provided in the apparatus main assembly side. Further, when the first projection 26*a* is disposed at the first end portion 24*a* of the first groove portion 24*a*1, the second projection 26*b* enters the second groove portion 24*a*2. As a result, the rotatable member 24*a* is rotated about the first projection 26*a*.

Compared with a conventional operating portion including dampers at its rotation center, in this embodiment, the sector gear which makes efficient use of a space is used and therefore it is possible to use a low torque damper which is small-sized and inexpensive. For example, compared with the case where conventional dampers 40 each having a rotation shaft of 10 mm in diameter at a rotation center of an operating portion 22 as shown in FIG. 21 is used, when the slide gear 27*a* which is the sector gear as in this embodiment is used, a radius of the slide gear 27*a* is about 7 times a radius of the conventional dampers 40 and therefore the damper having the torque which is about 1/7 of the torque of the conventional dampers 40 may only be required to be used. In this embodiment, the slide gear 27*a* as the sector gear is a plate-like member extending substantially in one direction and therefore is very advantageous in terms of downsizing.

When the number of rotations of the slide gear 27*a* as the sector gear relative to the damper gear 32*a* of the oil damper 32 is decreased, i.e., when a gear ratio is increased, it is possible to use a lower torque damper. At least when the number of rotations of the slide gear 27*a* as the sector gear is small relative to the damper gear 32*a* of the oil damper 32, it is possible to use the damper having a lower torque than that in the case where the damper is used at the rotation center. That is, the number of rotations of the first gear provided concentrically with the operating portion 22 as the rotatable unit may only be required to be smaller than the number of rotations of the rotatable portion of the resistance generating means. Incidentally, the slide gear 27*a* in this embodiment is the sector gear and therefore the number of rotations of the slide gear 27*a* refers to the number of rotations of a circular gear which has the same radius as the slide gear 27*a* and which has the same pitch at teeth of the slide gear 27*a*. Incidentally, in this embodiment, the slide gear 27*a* is not rotated but the number of rotations thereof refers to that on the assumption that the slide gear 27*a* is rotated.

Incidentally, the oil damper 32 is not necessarily required to be provided at the position in this embodiment. For example, as desired, an oil damper similar to the oil damper 32 in this embodiment may also be provided at the position of the gear 31 or the gear 33 in this embodiment, and a gear similar to the gear 31 or the gear 33 in this embodiment may also be provided at the position of the oil damper 32 in this embodiment. In this case, the gear as the second gear provided at the position of the oil damper is the damper gear. Accordingly, the damper gear as the second gear is fixed and integrated with the rotor 32*c* of the resistance generating means constituted by the damper case 32*b*, the rotor 32*c*, the silicone oil 32*d* and the like, thus being connected directly to the resistance generating means. Further, the gear as the second gear located at the position where the oil damper is not provided is connected to the resistance generating means via the gear disposed at the position of the drive in this embodiment and the damper gear as the second gear. Also in this case, an effect similar to that in this embodiment can be obtained and therefore there is a degree of freedom of arrangement.

Further, as shown in FIG. 13, a gear engaging with the gears 31 and 33 may be constituted as a reduction gear 34 including a wheel (large gear) 34*a* and a pinion (small gear) 34*b*, and the pinion 34*b* is engaged with the gears 31 and 33, and concurrently the wheel 34*a* may be engaged with the damper gear 32*a* of the oil damper 32. In an example of FIG. 13, the number of teeth of the wheel 34*a* is 21 teeth, and the number of teeth of the pinion 34*b* is 12 teeth. As a result, it is possible to use the oil damper having a further low torque. The reduction gear 34 may also be disposed at the position of the gear 31 or 33 as desired.

On the other hand, as in a comparison example shown in FIG. 14, when a constitution in which a damper gear 32*a* of an oil damper 32 and a slide gear 27*a* are directly engaged with each other is employed, in order to obtain a rotation amount to the same degree, there is a need to increase the number of teeth of the slide gear 27*a*. As a result, compared with this embodiment, regions of hatched-line portions F1 and F2 are protruded from the surface of the oil damper and therefore the operating portion cannot be made thin. Further, a hatched-line portion F3 is a slide region of the slide gear 27*a*, and another part cannot be disposed in this region, so that the space cannot be effectively used.

Thus, according to this embodiment, the size of the operating portion 22 can be made smaller than that of the operating portion having the constitution as shown in FIG. 14, so that it is possible to further effectively use the space.

As described above, in this embodiment, the image forming apparatus 100 includes the apparatus main assembly 1 and the rotatable unit 22 provided rotatably relative to the apparatus main assembly 1. Further, the image forming apparatus 100 includes the first gear 27*a* which is provided in the apparatus main assembly side so as not to be rotated in the rotational direction of the rotatable unit 22 and which is provided substantially concentrically with the rotatable unit 22. Further, the image forming apparatus 100 includes the plurality of second gears 31 and 33 each provided in the side (rotatable unit side), of the apparatus main assembly side and the rotatable unit side, where the first gear 27*a* is not provided, so as to be engageable with the first gear 27*a* and so as to be drive-connected with another second gear. Further, the image forming apparatus 100 includes the resistance generating means 32, provided in the rotatable unit side together with the plurality of second gears 31 and 33, for generating a resistance to the rotation motion of the plurality of second gears 31 and 33. The resistance generating means may also be one including a rotatable portion which is rotated integrally with at least one of the plurality of second gears 31 and 33 or which is drive-connected to the plurality of second gears 31 and 33 via at least one of the plurality of second gears 31 and 33. In this embodiment, the oil damper 32 as the resistance generating means is engaged with both of the two gears 31 and 33 as the second gears. Further, the number of teeth of the first gear 27*a* is smaller than the number of teeth of the rotatable portion 32*c* of the resistance generating means 32. In this embodiment, the first gear 27*a* is disposed so as not to be rotated relative to the apparatus main assembly 1 in the rotational direction of the rotatable unit 22, and the second gears 31 and 33 and the resistance generating means 32 is disposed so as to be rotatable relative to the apparatus main assembly 1 in the rotation direction of the rotatable unit 22. Further, the plurality of second gears 31 and 33 have centers thereof located on a circumference with a center substantially aligned with the rotation center of the rotatable unit 22.

As a result, a slimming down of the operating portion 22 as the rotatable unit rotatable relative to the apparatus main assembly 1 can be realized. That is, the low torque damper which is small in size and which is inexpensive can be disposed in a small space and therefore it is possible to realize the slimming down of the rotatable unit with an inexpensive constitution and downsizing of the image forming apparatus. Thus, according to this embodiment, it is possible to provide an image forming apparatus which has realized the slimming down of the rotatable unit and the downsizing of the image forming apparatus by using minimum parts without increasing a cost and which has good operativity.

Incidentally, in this embodiment, the two second gears are used but three or more second gears may also be used. For example, in the case where three second gears are used, a constitution as shown in FIG. 15 is employed. A gear 42 is added as the second gear to the second gears 31 and 33 described with reference to FIG. 9, and a gear 41 engaged with the gear 31 and the gear 42 is further provided. Each of the gears 41 and 42 is a module and has 12 teeth. The gear 42 is, similarly as in the case of gears 31 and 33, disposed so that its center is located on a circumference with a center aligned with the center of the rear-side stepped screw 26*a*. Further, an angle D1 formed between a line connecting the center of the stepped screw 26*a* and the center of the gear 31 and a line connecting the center of the stepped screw 26*a* and the center of the gear 33 and an angle D3 formed between a line connecting the center of the gear 31 and a line connecting the center of the stepped screw 26*a* and the center of the gear 42 are the same. Accordingly, when the operating portion 22 is rotated, similarly as in the case where the slide gear 27*a* starts engagement with the gear 31, the slide gear 27*a* can smoothly start engagement with the gear 42. The slide gear 27*a* is engaged with either of the gears 31, 33 and 42 during the rotation of the operating portion 22 and therefore a torque for driving the damper gear 32*a* via these gears is generated. That is, even when the three second gears are used, a single oil damper 32 may only be required to be used. The number of the second gears is arbitrarily settable depending on the rotation angle of the rotatable unit. Thus, the low torque damper which is small in size and which is inexpensive can be disposed in a small space and therefore with an inexpensive constitution, it is possible to realize the slimming down of the rotatable unit and the downsizing of the image forming apparatus.

Embodiment 2

Next, another embodiment of the present invention will be described. A basic constitution of an image forming apparatus in this embodiment is the same as that in Embodiment 1. Accordingly, elements (portions) having the same or corresponding functions and constitutions are represented by the same reference numerals or symbols and will be omitted from detailed description.

In this embodiment, a gear train including an oil damper is provided so as not to be rotated in a rotation direction of an operating portion. Also in this embodiment, similarly as in Embodiment 1, the present invention is applied to a tiltable operating portion 22.

FIG. 16 is a left side view showing an inside structure of a scanner 19 and the operating portion 22. The operating portion 22 is provided at a lower position than a glass surface 19*b* so that an original is easy to be placed on the glass surface 19*b* of the scanner 19.

In front (right side in FIG. 16) of a frame 19*a* of the scanner 19, a shaft 35 as a rotation center of the operating portion 22 is provided. Between the scanner 19 and the operating portion 22, a bundle wire for supplying electric power (energy) to the operating portion 22 and a space (bundle wire accommodating region) G for accommodating the bundle wire for communicating with a controller (not shown) for controlling an operation of the apparatus main assembly 1 are provided. This space G is covered with a cover 37. Further, below the operating portion 22, a space is ensured, so that when the operating portion 22 is pushed down, the operating portion 22 is rotated about the shaft 35 and can be stopped at an arbitrary position until a position of a maximum tilted state indicated by a chain double-dashed line.

In this embodiment, a sector gear 36 rotatable about the shaft 35 together with the operating portion 22 is held by the operating portion 22. In this embodiment, the sector gear 36 is the first gear provided concentrically with the operating portion 22 as the rotatable unit. Further, inside the cover 37 and outside the bundle wire accommodating region G, three gears 31, 32*a* and 33 are provided on the frame 19*a*. These gears 31, 32*a* and 33 are rotatably held by the frame 19*a*. In this embodiment, the gears 31 and 33 are a plurality of second gears directly engageable with the slide gear 27*a* as the first gear described later. In this embodiment, each of the gears 31, 32*a* and 33 has 12 teeth in the number of teeth.

The gear 32*a* is a gear (damper gear) of an oil damper 32 engageable with the gears 31 and 33. The gears 31 and 33 have the same number of teeth and are disposed so that a center of each of the gears 31 and 32 is positioned on a circumference of concentric circles with the same center as the shaft 35 of which is the rotation center of the operating portion 22. Thus, the gears 31 and 33 are disposed along a circumferential direction of the arcuate slit 24*a*2, i.e., along the rotation direction of the sector gear 36 with respect to the frame 19*a*.

The operating portion 22 is ordinarily disposed substantially parallel to the scanner 19, so that the sector gear 36 is engaged with the gear 33 (normal state). In this state, a torque required for driving the gear 32*a* of the oil damper 32 by the sector gear 36 via the gear 33 is larger than a torque generated by the self-weight of the operating portion 22 and by an urging force when the operator presses down a key. Therefore, the operating portion 22 is held in a self-standing state.

When the operating portion 22 is pressed downward and is rotated in the clockwise direction, also the sector gear 36 is rotated in the clockwise direction, so that the sector gear 36 is engaged with the gear 31 before it is separated from the gear 31.

The rotation of the operating portion 22 is regulated by a stopper (not shown) when the operating portion 22 is rotated by about 50 degrees, so that the operating portion 22 is placed in the maximum tilted state as indicated by the chain double-dashed line in FIG. 16.

The operations of the gears 31, 32*a* and 33 are the same as those in Embodiment 1 and therefore will be omitted from description.

Also in this embodiment, similarly as in Embodiment 1, the size of the operating portion 22 can be reduced and in addition, the space can be effectively used.

On the other hand, as in a comparison example shown in FIG. 17, when a constitution in which a damper gear 32*a* of an oil damper 32 and the sector gear 36 are directly engaged with each other is employed, there is a need to always engage the sector gear 36 with the gear 32*a*, and therefore the number of teeth of the sector gear 36 is increased. When the sector gear 36 is prevented from protruding toward below the operating portion 22, there is a need to dispose the damper gear 32*a* at an upper portion. In order to prevent H1 portion of the damper gear 32*a* from contacting a cover 37, there is a need to increase the size of the scanner 19. Further, in the maximum tilted state, H2 portion of the sector gear 36 is exposed and therefore from the viewpoint of safety, there is a need to cover the H2 portion with the cover. In order to avoid the above inconvenience, as in a comparison example shown in FIG. 18, when the damper gear 32*a* is disposed at a lower portion, at a normal position where the operating portion is not tilted, H3 portion of the sector gear 36 protrudes toward below the operating portion 22. Further, as shown in FIG. 21, when the dampers 40 are provided at the rotation center of the operating portion 22, there is a need to use high-torque dampers each of which is expensive and large in size.

Thus, in this embodiment, the image forming apparatus 100 includes the first gear 36 which is provided in the rotatable unit side so as to be rotatable together with the rotatable unit 22 and which is provided substantially concentrically with the rotatable unit 22. Further, the image forming apparatus 100 includes the plurality of second gears 31 and 33 each provided in the side (apparatus main assembly side), of the apparatus main assembly side and the rotatable unit side, where the first gear 36 is not provided, so as to be engageable with the first gear 36 and so as to be drive-connected with another second gear. Further, the image forming apparatus 100 includes the oil damper 32, as the resistance generating means similar to that in Embodiment 1. Further, the number of teeth of the first gear 36 is smaller than the number of teeth of the rotatable portion 32*c* of the resistance generating means 32. In this embodiment, the first gear 36 is disposed so as to be rotatable relative to the apparatus main assembly 1 in the rotational direction of the rotatable unit 22, and the second gears 31 and 33 and the resistance generating means 32 is disposed so as not to be rotated relative to the apparatus main assembly 1 in the rotation direction of the rotatable unit 22.

Even in such a constitution, it is possible to downsize the rotatable unit with an inexpensive constitution.

Further, as in this embodiment, in the constitution in which the sector gear 36 is always engaged with either one of the gears 31 and 33, even when the operating portion 22 is rotated any number of times, these gears are always engaged with each other by the same teeth. The same is true for the case where the gears 31 and 33 are different in the number of teeth. Accordingly, as a first step, when the sector gear 36 can be phase-adjusted so as to be moved between the gears 31 and 33, even with respect to the gears different in the number of teeth, an occurrence of inconvenience of drive transmission due to phase shift is prevented irrespective of the number of times of the tilting. As a result, it is possible to change the rotation torque in midstream of the rotation. Such a constitution is effective in, e.g., in the case where a torque generated by a tilt angle (such as a torque for rotating the operating portion by the self-weight of the operating portion) is changed and therefore the torque is intended to be controlled depending on the tilt angle. An example thereof will be described with reference to FIG. 19.

FIG. 19 shows a constitution in which the gear 33 in FIG. 16 is changed to a stepped gear (speed change gear) 38.

A force by which the operating portion 22 will rotate by its own weight is maximum at the time of the normal state of the operating portion 22, and is gradually decreased until the operating portion 22 is rotated in the clockwise direction to be placed in the maximum tilted state indicated by a chain double-dashed line shown in FIG. 19. Accordingly, a torque required for driving the oil damper 32 by the sector gear 36 via the gear 31 or the stepped gear 38 can be reduced in the maximum tilted state more than in the normal state of the operating portion 22. As a result, it is possible to more properly adjust an operating force necessary when the operator tilts the operating portion 22.

For example, the stepped gear 38 is a gear module including a pinion 38*b* having 12 teeth and a wheel 38*a* having 16 teeth. The pinion 38*b* and the wheel 38*a* are engaged with the sector gear 36 and the damper gear 32*a* of the oil damper 32, respectively.

When the operating portion 22 is in the normal state, the sector gear 36 is engaged with the stepped gear 38. Then, when the operating portion 22 is pushed down and is rotated in the clockwise direction in FIG. 19, also the sector gear 36 is rotated in the clockwise direction, so that the sector gear 36 starts engagement with the gear 31 before it is separated from the stepped gear 38.

Depending on the phase when the sector gear 38 is mounted, the phase at which the sector gear 36 transfers is also changed. For that reason, the phase at which the sector gear 36 is capable of smooth transfer is set in advance, and in order to permit engagement in that state, markings 36*a* and 38*c* for phase alignment are made on the sector gear 36 and the pinion 38*b* of the stepped gear 38, respectively. Then, the stepped gear 38 may desirably mounted in the phase-aligned state.

As described above, the sector gear 36 is always engaged with the stepped gear 38 or the gear 31 by the same teeth of these gears. For that reason, the phase is aligned when the stepped gear 38 is mounted, so that the sector gear 36 can be smoothly transferred from the stepped gear 38 to the gear 31.

By disposing the stepped gear 38, the torque for driving the gear 31 by the sector gear 36 is about 0.75 time (=12/16) the torque for driving the stepped gear 38 by the sector gear 36, so that the rotation torque can be switched in midstream of the rotation.

Thus, at least one of the second gears can be constituted as the speed change gear. In this case, during the rotation of the rotatable unit 22, the second gear with which the first gear is engaged is changed between the speed change gear and another gear, so that the rotation torque is changed.

Incidentally, in the example of FIG. 19, the two gears 38 and 31 are directly engageable with the sector gear 36 and therefore the switching is made in two stages, but when three gears are provided, it is also possible to make the switching in three stages. As desired, by providing a larger number of gears directly engageable with the sector gear 36, the rotation torque may also be switched in the larger number of stages. For example, in the case where the three-stage switching is enabled, such a constitution as shown in FIG. 20 is employed. To the constitution described with reference to FIG. 19, a stepped gear 44 and a gear 43 are added. The stepped gear 44 is the second gear and is a gear module including a pinion 44*b* having 12 teeth and a wheel 44*a* having 16 teeth. Further, the gear 43 is a gear module having 12 teeth and is engaged with the wheel 44*a* of the stepped gear 44 and with the pinion 38*b* of the stepped gear 38. The stepped gear 44 is, similarly as in the stepped gear 38, disposed so that its center is located on a circumference with a center aligned with the shaft 35 which is the rotation center of the operating portion 22. Also in this embodiment, similarly as in the case of the constitution of FIG. 19, depending on the phase when the stepped gears 38 and 44 are mounted first, the phase at which the sector gear 36 transfers is also changed. For that reason, the phase at which the sector gear 36 can smooth transfer is set in advance and in order to permit engagement in that state, makings 36*a* and 44*c* for phase alignment are provided on the sector gear 36 and the pinion 44*b* of the stepped gear 44, respectively. Further, also on the pinion 38*b* of the stepped gear 38 and the frame 19*a*, makings 38*c* and 19*c* for phase alignment are provided, and thus the stepped gears 38 and 44 may desirably be mounted in the phase-aligned state. As a result, the sector gear 36 can be smoothly transferred from the stepped gear 44 to the stepped gear 38 and then from the stepped gear 38 to the gear 31. By disposing the stepped gears 38 and 44, the torque for driving the gear 31 by the sector gear 36 is about 0.75 time (=12/16) the torque for driving the stepped gear 38 by the sector gear 36 and is about 0.56 time (=(12/16)×(12/16)) the torque for driving the stepped gear 44 by the sector gear 36. That is, the three second gears are provided, so that the rotation torque can be switched in three stages.

As described above, by the shift of the oil damper 32, the torque when the rotatable unit is rotated can be controlled, so that it is possible to not only downsize the rotatable unit in an inexpensive constitution but also improve operativity. Such a constitution of the damper mechanism 50 may also be applied to the slide and tilt mechanism as described in Embodiment 1.

According to the present invention, the rotatable unit provided so as to be rotatable relative to the apparatus main assembly can be downsized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 101848/2012 filed Apr. 26, 2012, which is hereby incorporated by reference.

What is claimed is:

1. An image forming apparatus comprising:

a main assembly;

a rotatable unit provided rotatably relative to said main assembly;

a first drive transmission member, provided in one of said rotatable unit and said main assembly, including a drive transmission portion at an arcuate portion having a center substantially aligned with a rotation center of said rotatable unit;

a second drive transmission member, provided rotatably in another one of said rotatable unit and said main assembly, engageable with said first drive transmission member in a first rotation region of said rotatable unit;

a third drive transmission member provided at a position different from a position of said second drive transmission member with respect to a circumferential direction of the arcuate portion of said first drive transmission member, wherein said third drive transmission member is engageable with said first drive transmission member when said rotatable unit is rotated in a second rotation region thereof; and a damper mechanism for imparting rotational resistance to said second and third drive transmission members when each of said second and third drive transmission members is rotated.

2. An image forming apparatus according to claim 1, wherein said second and third drive transmission members are drive-connected with each other.

3. An image forming apparatus according to claim 1, wherein said damper mechanism includes a rotatable portion rotatable integrally with said second drive transmission member or said third drive transmission member or includes a rotatable portion for being drive-connected with said second drive transmission member or said third drive transmission member, and wherein the number of rotations of said first drive transmission member is smaller than that of said rotatable portion.

4. An image forming apparatus according to claim 1, wherein rotation centers of said second and third drive transmission members are provided on a circumference with a center substantially aligned with the rotation center of said rotatable unit.

5. An image forming apparatus according to claim 1, wherein the first rotation region and the second rotation region overlap with each other.

6. An image forming apparatus according to claim 1, further comprising:

a first groove portion provided in a linear shape in a side where said rotatable unit is provided;

a second groove portion provided in an arcuate shape, in the side where said rotatable unit is provided, so as to be merged with said first groove portion and so that the arcuate shape has a center located at a first end portion of said first groove portion;

a rotatable member on which said second drive transmission member and said damper mechanism are provided; and first and second projections provided, in a side where said main assembly is located, so as to be movable in said first groove portion and so as to be fixed to said first drive transmission member, wherein when said first projection is located at the first end portion of said first groove portion, said second projection enters said second groove portion to rotate said rotatable member with said first projection as a rotation center.

7. An image forming apparatus according to claim 1, wherein at least one of said second and third drive transmission members is a speed change gear, and wherein during rotation of said rotatable unit, a rotational torque when said first drive transmission member is engaged with said second drive transmission member is different from a rotational torque when said first drive transmission member is engaged with said third drive transmission member.

8. An image forming apparatus according to claim 1, wherein said rotatable unit is provided so that its rotational torque is decreased during rotation of an operating surface from a horizontal state position to an inclined state position.

9. An image forming apparatus according to claim 1, wherein said rotatable unit is an operating portion, for operating said image forming apparatus, capable of rotating an operating surface toward a side where the operating surface is to be operated.

* * * * *